US007500274B1

(12) United States Patent
Kallen

(10) Patent No.: US 7,500,274 B1
(45) Date of Patent: Mar. 10, 2009

(54) EQUESTRIAN PANTS

(75) Inventor: Peter Joseph Kallen, Portland, OR (US)

(73) Assignee: Toklat Originals, Inc., Lake Oswego, OR (US)

( * ) Notice: Subject to any disclaimer, the term of this patent is extended or adjusted under 35 U.S.C. 154(b) by 137 days.

(21) Appl. No.: 10/376,671

(22) Filed: Feb. 26, 2003

(51) Int. Cl.
*A41D 1/06* (2006.01)

(52) U.S. Cl. ..... 2/227; 2/267

(58) Field of Classification Search ..... 2/214, 2/215, 22, 23, 24, 69, 79, 227, 228, 231, 2/232, 233, 238, 242, 241, 267, 275; D2/742
See application file for complete search history.

(56) References Cited

U.S. PATENT DOCUMENTS

| | | | | | |
|---|---|---|---|---|---|
| 121,250 | A | * | 11/1871 | Lansingh, Jr. | 2/404 |
| 133,138 | A | * | 11/1872 | Bellamy | 2/404 |
| 1,211,766 | A | * | 1/1917 | Schremp | 2/78.1 |
| 1,861,704 | A | * | 6/1932 | Manke | 2/227 |
| 2,119,602 | A | * | 6/1938 | Roberts et al. | 2/227 |
| 2,146,494 | A | * | 2/1939 | Adamson | 2/228 |
| 2,203,401 | A | * | 6/1940 | Barnard | 2/407 |
| 2,318,199 | A | * | 5/1943 | Clements | 2/407 |
| 3,800,330 | A | * | 4/1974 | Bowcut | 2/227 |
| 3,813,697 | A | | 6/1974 | Belpaume | |
| 3,959,826 | A | * | 6/1976 | Hakanson | 2/227 |
| 4,261,060 | A | * | 4/1981 | Zawacki | 2/227 |
| 4,371,989 | A | * | 2/1983 | Polsky | 2/227 |
| 4,488,317 | A | * | 12/1984 | Polsky | 2/227 |
| 4,532,657 | A | * | 8/1985 | Revene | 2/409 |
| 4,625,336 | A | * | 12/1986 | Derderian | 2/79 |
| 4,785,480 | A | * | 11/1988 | Polsky | 2/227 |
| 4,843,654 | A | | 7/1989 | March | |
| 4,850,056 | A | | 7/1989 | Gardner et al. | |
| 4,987,613 | A | * | 1/1991 | Loverdi et al. | 2/23 |
| 5,033,123 | A | * | 7/1991 | Audet | 2/227 |
| 5,210,877 | A | * | 5/1993 | Newman | 2/456 |

(Continued)

FOREIGN PATENT DOCUMENTS

FR WO 96/10930 * 9/1985

OTHER PUBLICATIONS

Web content from www.adamleathers.com/ladwinwiniic.html, accessed on Oct. 3, 2002, pp. 1-3.

(Continued)

*Primary Examiner*—Alissa L Hoey
(74) *Attorney, Agent, or Firm*—Klarquist Sparkman, LLP

(57) ABSTRACT

Equestrian pants having shaped side panels are disclosed. A leg portion of the equestrian pants has at least one side panel connected to an inner panel at multiple side seams. The side panel and the side seams are located on an outward-facing side of the pants so that the saddle-facing side is seamless. The side panel is shaped to include preformed bends at a knee region and at an upper-thigh region. For instance, in an embodiment where the pants are made of a stretchable fabric, the side panel shapes the leg portion into a riding position. Thus, the fabric of the pants may be stretched evenly across the legs and lower torso of the rider while riding. The side seams may also form contoured paths that extend around and out of direct contact with natural bone protrusions of the rider. A method of designing the equestrian pants is also disclosed.

28 Claims, 8 Drawing Sheets

U.S. PATENT DOCUMENTS

| | | | | | |
|---|---|---|---|---|---|
| 5,271,101 | A | * | 12/1993 | Speth et al. | 2/228 |
| 5,282,277 | A | * | 2/1994 | Onozawa | 2/69 |
| 5,367,708 | A | * | 11/1994 | Fujimoto | 2/22 |
| 5,737,772 | A | * | 4/1998 | Dicker et al. | 2/69 |
| 5,822,802 | A | * | 10/1998 | Chou | 2/227 |
| D413,008 | S | * | 8/1999 | Fujii et al. | D2/742 |
| 5,946,721 | A | * | 9/1999 | Dance | 2/69 |
| 5,956,775 | A | * | 9/1999 | Ezra | 2/227 |
| 6,041,437 | A | * | 3/2000 | Barker et al. | 2/82 |
| 6,041,442 | A | | 3/2000 | Owen | |
| 6,047,405 | A | * | 4/2000 | Wilkinson | 2/69 |
| D427,750 | S | * | 7/2000 | Fujii et al. | D2/738 |
| 6,115,838 | A | * | 9/2000 | Scholtis et al. | 2/46 |
| D436,714 | S | * | 1/2001 | Korff | D2/742 |
| 6,170,089 | B1 | * | 1/2001 | Marchetti | 2/275 |
| D460,602 | S | * | 7/2002 | Tanaka | D2/742 |
| 6,421,831 | B1 | * | 7/2002 | Korff | 2/69 |
| D461,943 | S | * | 8/2002 | Lyden | D2/742 |
| 6,446,264 | B2 | * | 9/2002 | Fairhurst et al. | 2/69 |
| D473,694 | S | * | 4/2003 | Lyden | D2/742 |
| 6,611,964 | B2 | * | 9/2003 | Lipsett et al. | 2/227 |
| D483,551 | S | * | 12/2003 | Kallen | D2/742 |
| D514,775 | S | | 2/2006 | Szabo | |
| D532,958 | S | * | 12/2006 | Kent | D2/742 |
| 2001/0004771 | A1 | * | 6/2001 | Chou | 2/227 |
| 2001/0014981 | A1 | * | 8/2001 | Fairhurst et al. | 2/69 |
| 2002/0007506 | A1 | * | 1/2002 | Graham | 2/227 |
| 2003/0084497 | A1 | * | 5/2003 | Shiozaki et al. | 2/93 |
| 2004/0111781 | A1 | * | 6/2004 | Miyake et al. | 2/69 |
| 2005/0166298 | A1 | * | 8/2005 | Pieroranzio | 2/69 |
| 2005/0193461 | A1 | * | 9/2005 | Caillibotte et al. | 2/69 |
| 2006/0230488 | A1 | * | 10/2006 | Rudolph | 2/69 |
| 2006/0277645 | A1 | * | 12/2006 | Okajima | 2/69 |

OTHER PUBLICATIONS

Web content from www.ariat.com/products/apparel.cfm, accessed on Oct. 3, 2002, pp. 1.
Web content from www.arnottmason.com/cgi-bin/justbreeches/catalog, accessed on Oct. 10, 2003, pp. 1-9.
Web content from www.caldene.co.uk/jodhpurs, accessed on Oct. 1, 2002, pp. 1-6.
Web content from www.devonaire.com/outlet.html, accessed on Sep. 27, 2002, pp. 1-3.
Web content from www.doversaddlery.com/display, accessed on Oct. 9, 2002, pp. 1-11.
Dover Saddlery, The Source, 2002-2003 Catalog, pp. 1-25.
Web content from www.equisearchstores.com/Merchant2/merchant, accessed Oct. 3, 2003, pp. 1-10.
Web content from www.equissentials.net, accessed Oct. 9, 2003, pp. 1-13.
Web content from www.equitux.com/Tallyholtd, accessed Oct. 3, 2002, pp. 1-13.
Web content from www.eurosaddlery.com/ecom, accessed Oct. 1, 2002, pp. 1-19.
Web content from www.golden-dress.de/trend.htm, accessed Oct. 10, 2003, pp. 1-4.
Web content from www.gorringeridingwear.sagenet.co.uk/products.htm, accessed Oct. 4, 2002, pp. 1-4.
Web content from www.hac-tac.co.uk/original.htm, accessed Oct. 3, 2002, pp. 1-7.
Web content from www.heritagesaddlery.com, accessed Oct. 4, 2002, pp. 1-7.
Web content from www.horka.nl/2.1.html, accessed Oct. 4, 2002, pp. 1.
Web content from www.horse-rider-etc.com/clothing, accessed Oct. 3, 2002, pp. 1-8.
Web content from www.huntfields.com/products/Show Product.cfm, accessed Oct. 4, 2002, pp. 1-7.
Web content from www.instridemfg.com, accessed Oct. 1, 2002, pp. 1-9.
Web content from www.jrd-tack.com/solana.htm, accessed Oct. 1, 2002, pp. 1-2.
Web content from www.jumperking.com/engl/products, accessed Oct. 1, 2002, pp. 1-6.
Web content from www.kellystackshop.com, accessed Oct. 10, 2002, pp. 1-8.
Web content from www.kerrits.com/product_details.asp, accessed Oct. 3, 2002, pp. 1-5.
Web content from www.longmelfordsaddlery.co.uk/shop/Leather, accessed Oct. 3, 2002, pp. 1.
Web content from www.millerharness.com, pp. 1-32.
Web content from www.okeaheys.com/catalog.htm, accessed Oct. 3, 2002, pp. 1-2.
Web content from www.patagonia.com/za/PDC/Pgonia/search, accessed Oct. 3, 2002, pp. 1-4.
Web content from www.performancebike.com/shop/large_photo.html, accessed Dec. 5, 2002, pp.1.
Web content from www.pikeur.de/uk/pikeur_collection, accessed Oct. 1, 2002, pp. 1-4.
Web content from www.rhmiller.co.uk/jodhpurs.htl, accessed Sep. 27, 2002, pp. 1.
Web content from www.ridersupply.com/apparel, accessed Oct. 3, 2002, pp. 1-10.
Web content from www.rsn.altrec.com/shop/detail, accessed Dec. 5, 2002, pp. 1.
Web content from www.runningfox.com/apparel/clothes/Full/The_royal_hunter.html, accessed Oct. 4, 2002, pp. 1.
Web content from www.sporthorsespecialties.com/breeches, accessed Oct. 3, 2002, pp. 1-6.
Web content from www.sugoi.ca/productlrg.asp, accessed Dec. 5, 2002, pp. 1.
Web content from www.tackinthebox.com/clothes/breeches, accessed Oct. 10, 2002, pp. 1-4.
Web content from www.tackwarehouse.com/Zoom.cfm, accessed Oct. 10, 2002, pp. 1-28.
Web content from www.tattini.it/breeches.htm, accessed Oct. 3, 2002, pp. 1.
Web content from www.teamestrogen.com/products.asp, accessed Dec. 5, 2002, pp. 1-2.
Web content from www.texaspolo.com/cgi-cart, accessed Oct. 1, 2002, pp. 1.
Web content from www.tropicalrider.com/Merchant2/merchant.mv, accessed Oct. 3, 2002, pp. 1-20.
Web content from www.victorycanter.com, accessed Oct. 4, 2002, pp. 1.
Web content from www.windsorapparel.com.au/pop, accessed Oct. 9, 2002, pp. 1-7.
Web content from www.zilco.com/au/clh, accessed Oct. 10, 2002, pp. 1-9.

* cited by examiner

EQUESTRIAN PANTS

FIELD

This application relates to pants worn while horseback riding.

BACKGROUND

While riding in the saddle, an equestrian rider typically experiences a repetitive motion that creates friction between the saddle and the rider. Moreover, an equestrian rider often exerts pressure on her inner legs and knees to control the horse and maintain stability in the saddle. As a result of this friction and pressure, the skin on the legs and bottom of an equestrian rider can become irritated or chafed.

For this reason, horseback riders typically wear some type of equestrian pants while riding. Equestrian pants are usually designed to provide a durable, protective surface between the rider and the saddle. Some of the known equestrian pants are manufactured from a stretchable, synthetic material that stretches around the rider's legs and lower torso. Equestrian pants of this nature are referred to as riding breeches or tights. Some of the known equestrian pants also include an additional protective surface attached to the exterior surface of the pants. The protective surface provides added durability to the pants and typically is made of a material that helps prevent the rider from slipping in the saddle. The protective surface may be in the form of a full-seat patch, which extends along the entire backside of the rider, or separate knee patches, which are positioned on the inward-facing sides of the rider's knees.

Some of the known riding pants are constructed from four panels of fabric, which are attached at a central crotch seam, an outseam, and an inseam. This construction suffers from a number of disadvantages. For instance, the inseam typically makes direct contact with the saddle when the pants are worn by a rider, creating a major point of friction and abrasion. Further, the outseam is typically located adjacent to areas of the rider's body that are susceptible to irritation. In particular, the outseam is usually positioned adjacent to the rider's hipbones and upper ends of the femur. These areas protrude slightly and are easily irritated by constant friction imparted by the adjacent outseam.

Other known riding pants are constructed from two panels connected at two outseams—one on each leg of the pants. This construction similarly suffers from the disadvantage of having the outseam located at a position on the rider's body susceptible to irritation. Further, the use of only two panels and a single outseam limits the degree to which the pants can be shaped or preformed to the body of the rider.

The pant legs of the known riding pants are typically not shaped in any way unique to equestrian riding. Instead, the typical pant leg is shaped to extend in a straight line from the upper thigh of the rider to the ankle (i.e., in the shape of a straightened leg). As a result, these pants fit best when the rider is standing and tend to limit the range of motion of the rider while riding. When a rider's legs are bent and spread slightly, as they are when riding in a saddle, the pants tend to bunch or crease. For instance, the knee, upper-thigh, crotch, and waist regions of the rider tend to bunch or crease when the rider is in a riding position. This bunching creates additional points of friction that abrade the rider's skin and create an uncomfortable fit. Further, the known riding pants that are shaped have only a single outseam on each leg and include only minimal curving at a knee region of the pants.

SUMMARY

The detailed description is directed to various features of equestrian pants that address the disadvantages of the prior art. The various features may be implemented in combination or individually in a pair of equestrian pants.

In a first aspect, the equestrian pants have an inner panel partially forming a leg portion of the pants. The pants further include at least one side panel connected to the inner panel at multiple side seams. The side panel and the side seams are located on the outward-facing side of the pants so that the saddle-facing side is seamless. The side panel is shaped to include preformed bends at a knee region and at an upper-thigh region. The side panel may shape the leg portion into a riding position, such as a seated riding position. The pants may also include a protective surface positioned on the saddle-facing side of the pants.

The side seams may include additional contours that accentuate the curves of the rider and have a slimming appearance. In one embodiment, for instance, the rearward seam of the side seams is shaped to include a buttocks-shaped contour and/or a calf-shaped contour. The side seams may also taper toward a waist region or an ankle region of the pants.

In another aspect, the equestrian pants are made of a stretchable material and the inner panel and side panel are shaped into a riding position such that the pants stretch substantially evenly across the legs and a portion of the lower torso of the rider. Thus, when the rider is in the riding position, the fabric of the pants does not bunch or crease and the fit of the pants is optimized.

In another aspect, two side seams connect a shaped side panel with an inner panel of the pants. The side seams are positioned on an outward-facing side of the pants and form contoured paths that extend around and out of direct contact with natural bone protrusions of the rider. For instance, the two side seams may extend around and out of contact with the rider's hipbone, hip joint, ischium, or the fibula head of the rider's leg. One of the side seams may extend around a forward side of the protrusion whereas the other side seam may extend around a rearward side. As a result of this configuration, irritation and abrasion caused by the seams of the pants is substantially reduced.

A method for designing equestrian pants is also disclosed. According to the method, a rider positioned in a riding position is examined. The examination includes measuring angles at which one of the rider's legs is bent. A side panel based on the measured angles is formed. The side panel extends from a waist region to an ankle region and is positioned along an outward-facing side of the pants. The side panel is connected to one or more other panels of the pants with two or more side seams such that no side seam is positioned on a saddle-facing side of the pants. The other panels are formed to complement and maintain the shape of the side panel when the pants are in a natural state.

The foregoing and additional features and advantages will be more readily apparent from the following detailed description, which proceeds with reference to the accompanying drawings.

DETAILED DESCRIPTION

Figure 1:
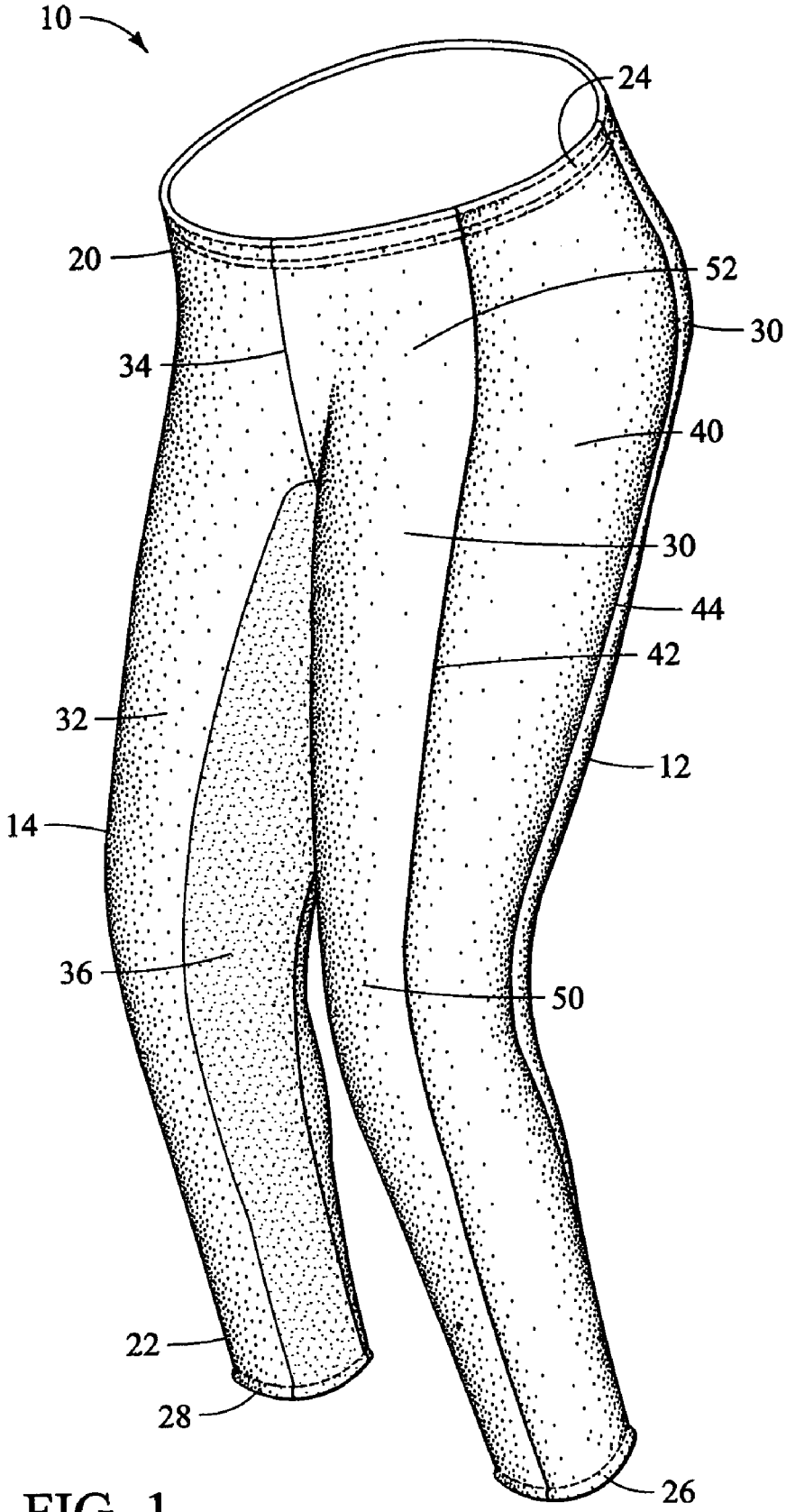
FIG. 1 is a front perspective view of the equestrian pants.

FIG. 1 shows a representative pair of equestrian pants 10 embodying several features of the disclosed technology. The pants 10 are shown in a three-dimensional state, but are not stretched or bent by any external forces. The pants 10 comprise two leg portions 12, 14 extending from a waist region 20 to an ankle region 22. The adjacent left and right leg portions 12, 14 are substantially mirror images of one another. A waistband 24 is attached at the waist region 20. The waistband 24 may comprise a band of stretchable fabric that supports the pants 10 around the waist of the rider. The waistband 24 may also include belt loops (not shown). Ankle cuffs 26, 28 are at the end of the ankle region 22 of each leg portion 12, 14. The ankle cuffs 26, 28 may be formed from a gripper elastic that secures the leg portions 12, 14 to the ankle region of the rider.

Each of the leg portions 12, 14 are formed from two or more pieces, or panels, of fabric. In the pants 10 illustrated in FIG. 1, for instance, the left leg portion 12 is formed from two panels: a left inner panel 30 and a left side panel 40. In other embodiments, however, the leg portion 12 may be formed from more than two panels. In FIG. 1, the inner panel 30 comprises the majority of the leg portion 12 and extends from the front of the leg portion, around an inward-facing (or saddle-facing) side of the leg portion, to the rear of the leg portion. The left side panel 40 is positioned on an outward-facing side, or outseam-side, of the leg portion 12. The right leg portion 14 is formed from a corresponding right inner panel 32 and a right side panel 45 (not shown). The left and right inner panels 30, 32 are connected at a seam 34, typically referred to as the crotch seam. The crotch seam 34 extends from a central position in the front of the waist region 20, under a crotch portion of the pants between the two leg portions 12, 14, to a central position at the back of the waist region (shown in FIG. 4).

The left side panel 40 is connected to the inner panel 30 at two seams: a forward seam 42 and a rearward seam 44. The inner panel 30 and the side panel 40 are shaped such that the seams 42, 44 have a contoured path. In the embodiment illustrated in FIG. 1, for instance, the inner panel 30 and the side panel 40 are preformed to provide the leg portion 12 with a slight backward bend at a knee region 50 and with a slight forward bend at an upper thigh region 52. The degree of bending may vary, but in one particular implementation, matches the angles of a horseback rider's leg when the rider is seated in the saddle with her feet in stirrups. In other implementations, the angles match the angles of a horseback rider's legs when the rider is in other positions (e.g., jumping position, two-point position, balancing position, etc.). In yet another implementation, the angles are selected to be between the angles of a rider's leg when standing and the angles when riding. In other implementations, the inner panel 30 and the side panel 40 may be shaped to include a slight spread in the legs of the pants 10 corresponding to the spread of a rider's legs while in the saddle. In other words, the panels 30, 40 are shaped such that the pants are slightly bow-legged, and thus fit better in the saddle.

The contoured path of the seams 42, 44 and the shape of the side panel 40 and the inner panel 30 shown in FIG. 1 help optimize the fit and comfort of the pants 10 when worn in a riding position. In one implementation, in which the pants 10 are made of a stretchable fabric, the shape of the side panel 40 and the inner panel 30 enables the fabric of the pants to be evenly stretched across a portion of the lower torso and legs of the rider while the rider is in a seated riding position. The evenly distributed stretching causes the fabric to sit flat against the skin of the rider's legs, crotch, and waist, thereby eliminating excess fabric at these regions of the rider's body. Thus, the bunching and creasing of fabric that typically occurs at the knees, upper thighs, crotch, and waist of the rider is substantially decreased. In other embodiments, the seams 42, 44, the side panel 40 and the inner panel 30 are designed to evenly distribute the stretching of the fabric while the rider is in other riding positions. In order to properly shape the side panel 40, and the inner panel 30, the pants 10 may be designed by analyzing and tracing the contours of a rider's lower torso and legs as the rider is seated in the saddle or in another desired riding position. Using the angles obtained in this analysis, the contoured side panel and the complementary inner panel may be formed from a suitable stretchable fabric.

The seams 42, 44 are also located such that they make no contact with a saddle when worn by a rider. Thus, chafing or irritation caused by the friction between the seams 42, 44 and the saddle is eliminated. Moreover, the seams 42, 44 may be positioned so that they are not directly adjacent to natural bone protrusions of the rider's lower torso. For instance, the seams 42, 44 may be positioned so that they are not directly adjacent to the rider's hipbone (i.e., the iliac crest), the rider's hip joint (i.e., the head or neck of the femur), the bones on which the rider sits (i.e., the ischium), or the protrusion near the rider's knee (i.e., the head of the fibula).

The fabric used to form the panels may vary. As noted, in one embodiment, the panels are formed of a stretchable material. For instance, the stretchable fabric may be formed from a synthetic fabric, such as a LYCRA®-based fabric wherein LYCRA® fibers are woven together with another synthetic fabric (e.g., polyester, nylon, etc.). The pants may exhibit a capillary action that wicks moisture away from the rider's skin to the outer surface of the pants. The fabric may also have a variety of surface textures or colors depending on the particular design and the desired durability. For example, the fabric texture may be substantially flat, corduroy, pitted, dimpled, or have some other textural feature. Moreover, the fabric may be colored or patterned in a variety of different manners.

Also shown in FIG. 1 is a protective surface 36 that provides an additional surface between the bottom and inner legs of the rider, and the saddle or horse's back. In the illustrated embodiment, the protective surface 36 is sewn onto the outer surface of the left and right inner panels 30, 32. Thus, the protective surface 36 is not part of the basic construction of the pants 10. The protective surface 36 may be a durable, gripping material that provides extra protection and grip between the lower torso and legs of the rider and the saddle. For instance, the protective surface 36 may be made of a synthetic material (e.g., synthetic leather, polyurethane, nylon, etc.) or a combination of materials. The texture of the protective surface 36 may vary in order to provide the desired gripping characteristics so that the pants 10 do not easily slip in the saddle. The protective surface 36 may also have a number of shapes and sizes. In the embodiment illustrated in FIG. 1 (and more fully shown in the rear view of FIG. 4), the protective surface 36 constitutes a full-seat patch, which extends from the buttocks region of the pants 10, down along the inner legs of the pants, to the ankle region. In other embodiments, however, the protective surface 36 may constitute one or more smaller patches and cover only a portion of the area shown in FIG. 4. For instance, in the embodiment illustrated in FIG. 8, the protective surface 36 comprises two knee patches 90, 92. The knee patches 90, 92 are located substantially near the inner knees of the pants 10. In still another embodiment, the pants 10 have no additional protective surfaces.

Figure 2:
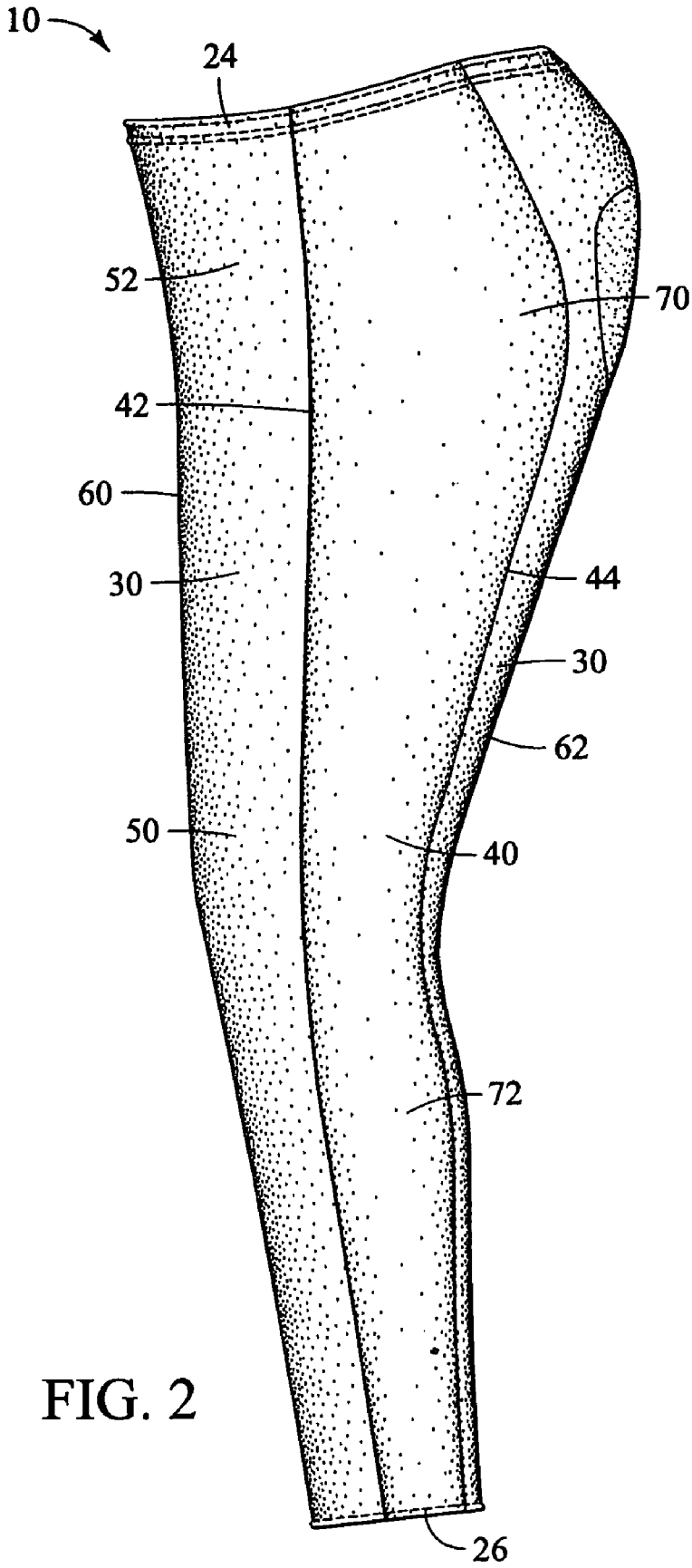
FIG. 2 is a left side view of the equestrian pants of FIG. 1.

As more fully illustrated in FIG. 2, the side panels 40, 45 of the pants 10 may also include other features that contribute to the comfort and shape of the pants. In FIG. 2, the left side of the pants 10 in FIG. 1 are shown. FIG. 2 shows the side panel 40, the inner panel 30, and the seams 42, 44 of the leg portion 12 described above. FIG. 2 also shows a front edge 60 and a rear edge 62 of the leg portion 12. As described above, the side panel 40 and the inner panel 30 are preformed and shaped such that the leg portion 12 has the general shape of a rider's leg in the riding position. In particular, and as seen in FIG. 2, the forward seam 42 and the front edge 60 are each bent slightly forward at an upper thigh region 52 of the pants. The forward seam 42 and the front edge 60 are also bent slightly backward at a knee region 50 of the pants.

The rearward seam 44 and the rear edge 62 may also include a number of other contours that contribute to the appearance of the pants. In the embodiment shown in FIG. 2, for example, the rearward seam 44 and the rear edge 62 form a contoured path that includes a smoothly curved portion 70 shaped around the buttocks region of the rider. The steepness of the curve at the buttocks-shaped portion 70 may vary to accentuate the rider's hips and waist. Above the buttocks-shaped portion 70, the rearward seam 44 and the forward seam 42 taper toward the waistband 24. Below the buttocks-shaped portion 70, the rearward seam 44 and the rear edge 62 extend toward the knee region 50. Below the knee region 50, the rearward seam 44 and the rear edge 62 form a smoothly curved, calf-shaped portion 72. The calf-shaped portion 72 is bulged to varying degrees to fit or accentuate the calf of the rider. From the calf-shaped region 72, the rearward seam 44 and the forward seam 42 taper slightly toward the ankle cuff 26. The tapering of the seams 42, 44 toward the waist region 20 and the ankle region 22 accentuates the natural curves of the rider and creates a slimming effect when viewed by an observer. Thus, the side panel 40 and the inner panel 30 may be shaped in a variety of ways to have a flattering appearance.

Also shown in FIG. 2 is the shape of the waistband 24. As seen in FIG. 2, the waistband 24 is angled slightly such that the back of the pants 10 fits higher around the rider's waist than the front. In other words, the length of the back of the pants 10 is longer than the length of the front of the pants. This additional length provides added support to the rider and ensures a tight fit and full coverage of the rider's backside when the rider bends her upper torso forward in the saddle (e.g., into a jumping position).

Figure 3:
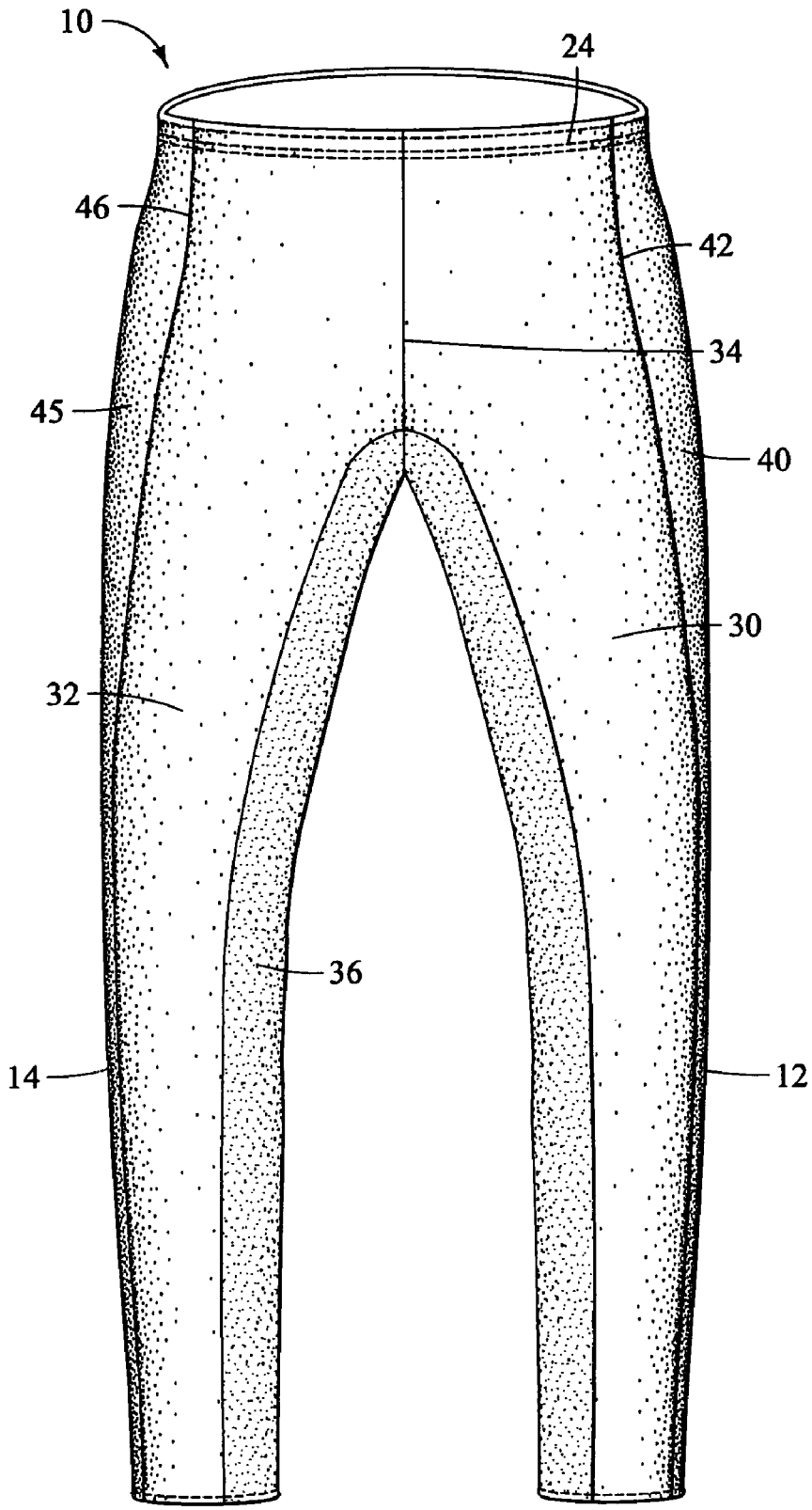
FIG. 3 is a front view of the equestrian pants of FIG. 1.

FIG. 3 shows a front view of the pants 10 illustrated in FIG. 1. In FIG. 3, the forward seam 42 from the left leg portion 12 and a corresponding forward seam 46 from the right leg portion 14 are shown tapering toward the waist region 20. As noted above, the tapered seams have a slimming appearance. The crotch seam 34 is shown connecting the left and right inner panels 30, 32 and extends from the waistband 24 through the crotch of the leg portions 12, 14. The left side panel 40 and the corresponding right side panel 45 are also partially shown. Finally, a portion of the protective surface 36 is shown. In particular, the protective surface 36 is shown extending around the saddle-facing sides of the leg portions 12, 14. Accordingly, in the illustrated embodiment, the protective surface 36 provides additional durability and gripping to the inner legs of the rider.

Figure 4:
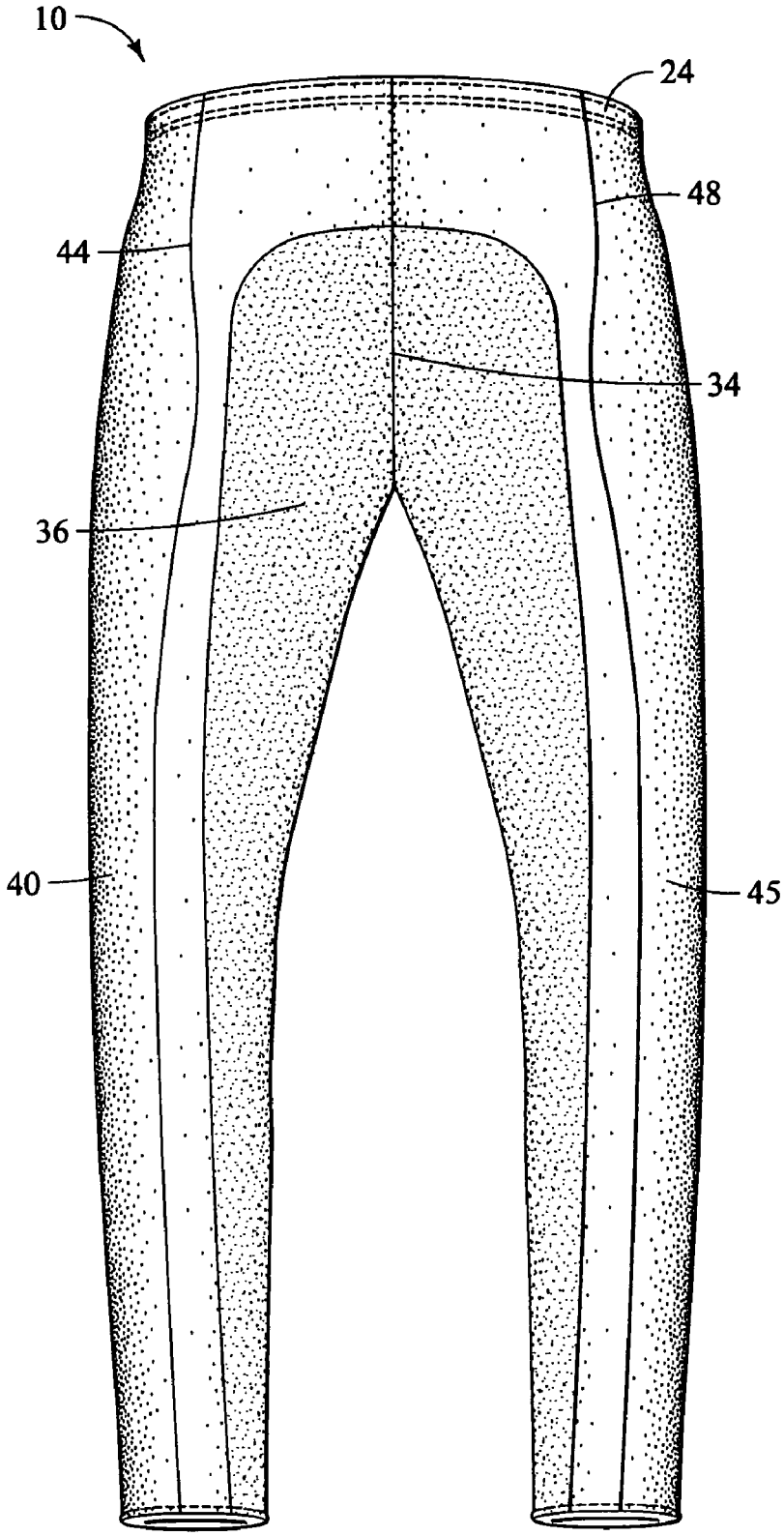
FIG. 4 is a rear view of the equestrian pants of FIG. 1.

FIG. 4 shows a back view of the pants 10 illustrated in FIG. 1. In FIG. 4, the rearward seam 44 from the left leg portion 12 and the corresponding rearward seam 48 from the right leg portion 14 are shown. The seams 44, 48 include a buttocks-shaped portion and taper slightly as they extend to the waistband 24. The position of the seams 44, 48 accentuates the natural curves of the rider and has a slimming appearance. The crotch seam 34 is also seen in FIG. 4 as it extends from the front side of the pants 10, around the crotch of the leg portions 12, 14, to the center of the waistband 24. Also seen in FIG. 4 is the protective surface 36. As noted above, the protective surface 36 of this embodiment constitutes a full-seat patch and provides a durable, gripping surface at the seat of the pants, where the majority of contact is made with the saddle while riding. As more fully described above, other configurations of the protective surface 36 are possible.

Figure 5:
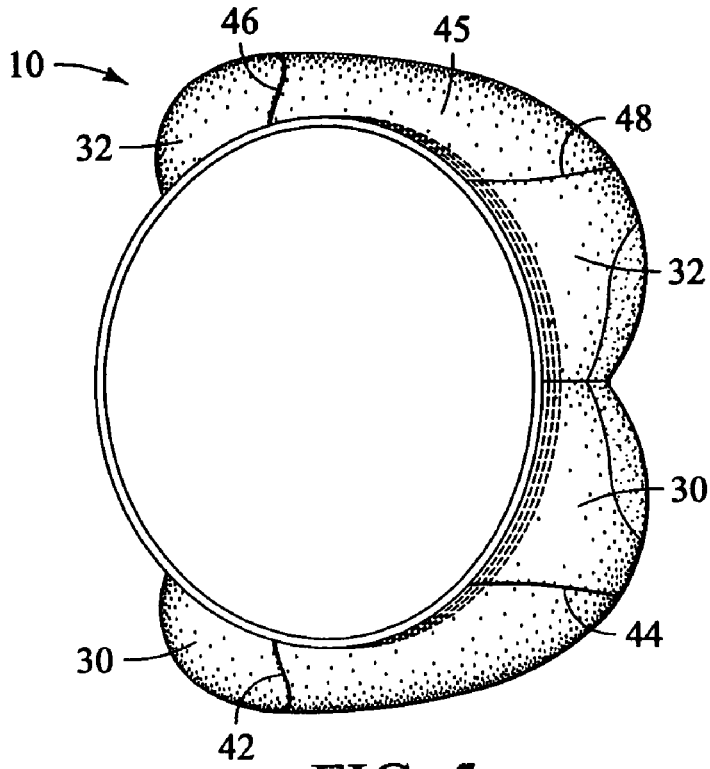
FIG. 5 is a top view of the equestrian pants of FIG. 1.

FIG. 5 shows a top view of the pants 10. The rearward seams 44, 48 are shown as they contour around the buttocks-shaped region of the side panels 40, 45. The forward seams 42, 46 are also shown as the extend down the sides of the pants. FIG. 5 also illustrates the inner panels 30, 32 and the side panels 40, 45.

Figure 6:
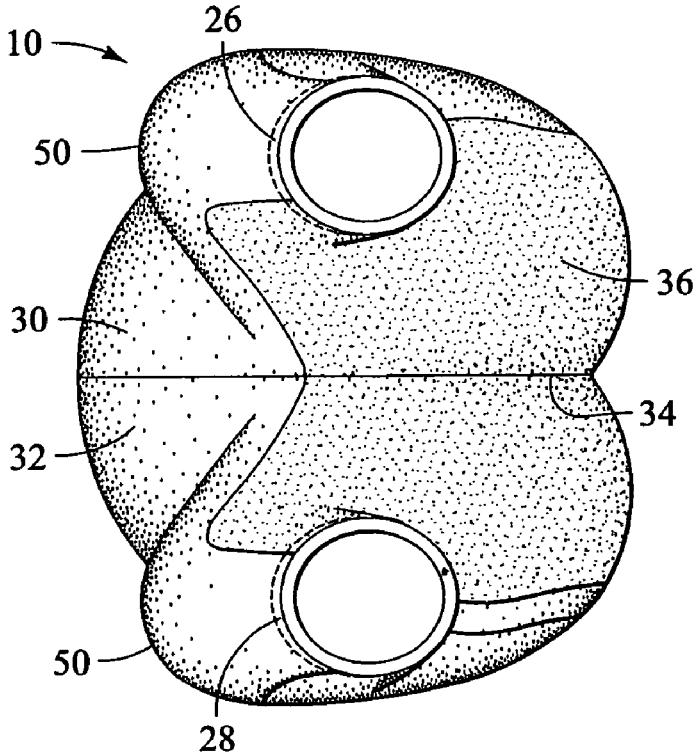
FIG. 6 is a bottom view of the equestrian pants of FIG. 1.

FIG. 6 shows a bottom view of the pants 10. In FIG. 4, the crotch seam 34 is shown connecting the inner panels 30, 32 to each other and extending through a crotch between leg portions 12, 14. The protective surface 36 is also shown. The ankle cuffs 26, 28 and their hollow interior are also shown. Also visible in FIG. 6 is the knee region 50 where the leg portions are bent slightly as a result of the shaped side panels 40, 45.

Figure 7:
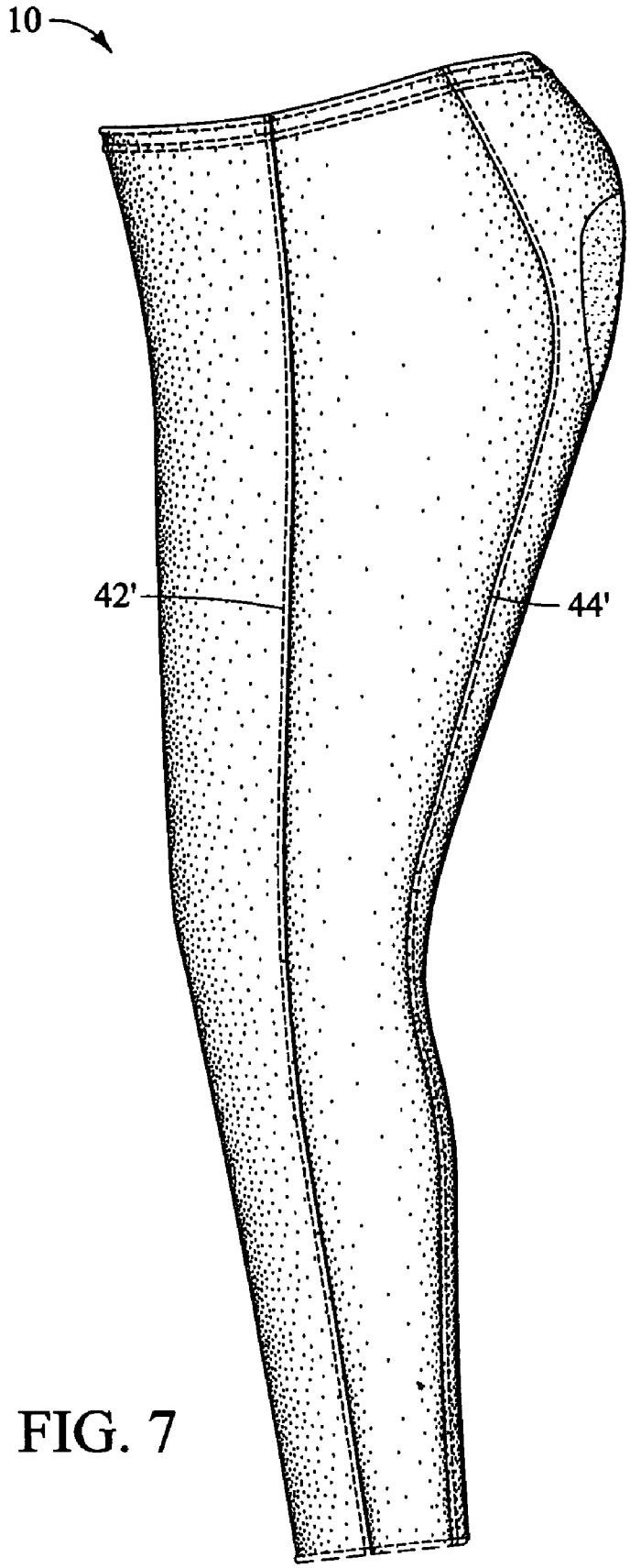
FIG. 7 is a left side view of the equestrian pants of FIG. 1 showing a first alternative seam style.
Figure 8:
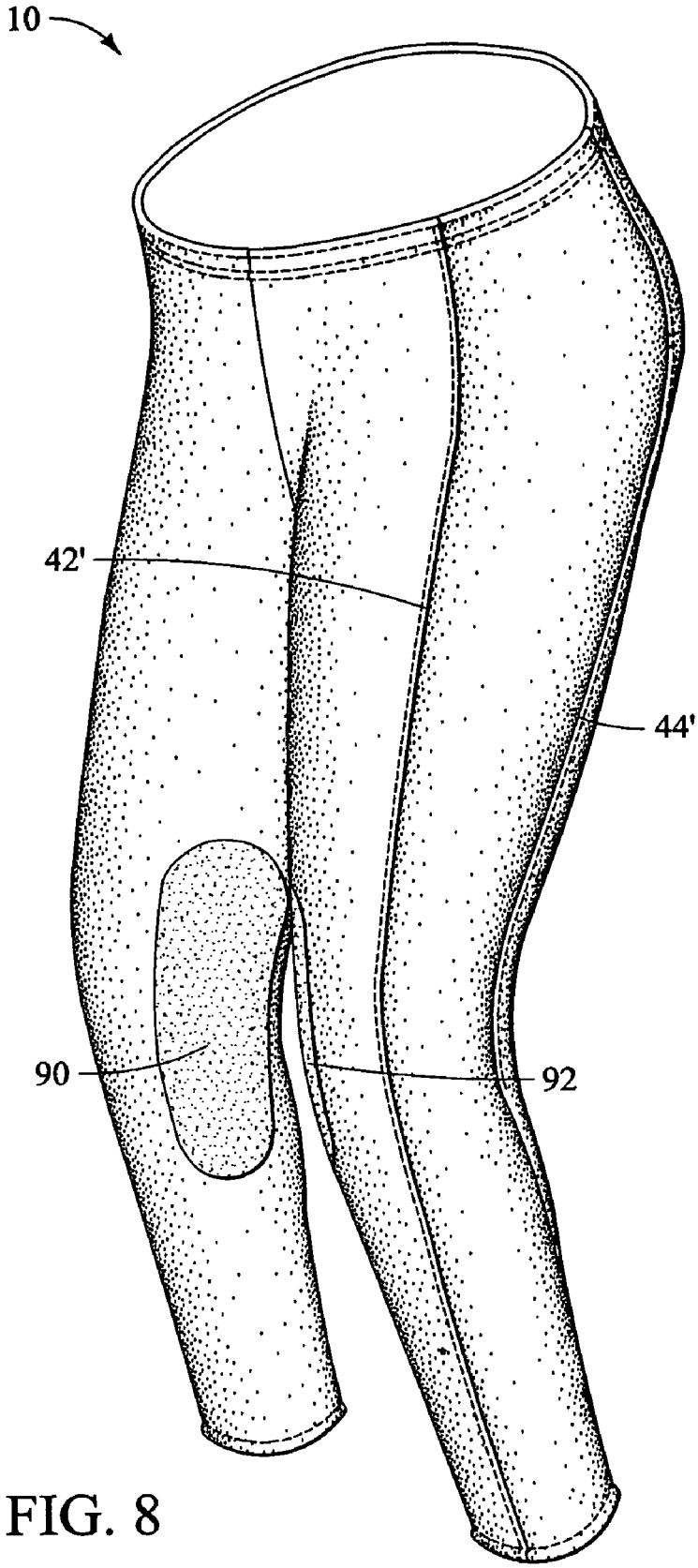
FIG. 8 is a perspective view of the equestrian pants of FIG. 7 further illustrating an embodiment having protective knee patches.
Figure 9:
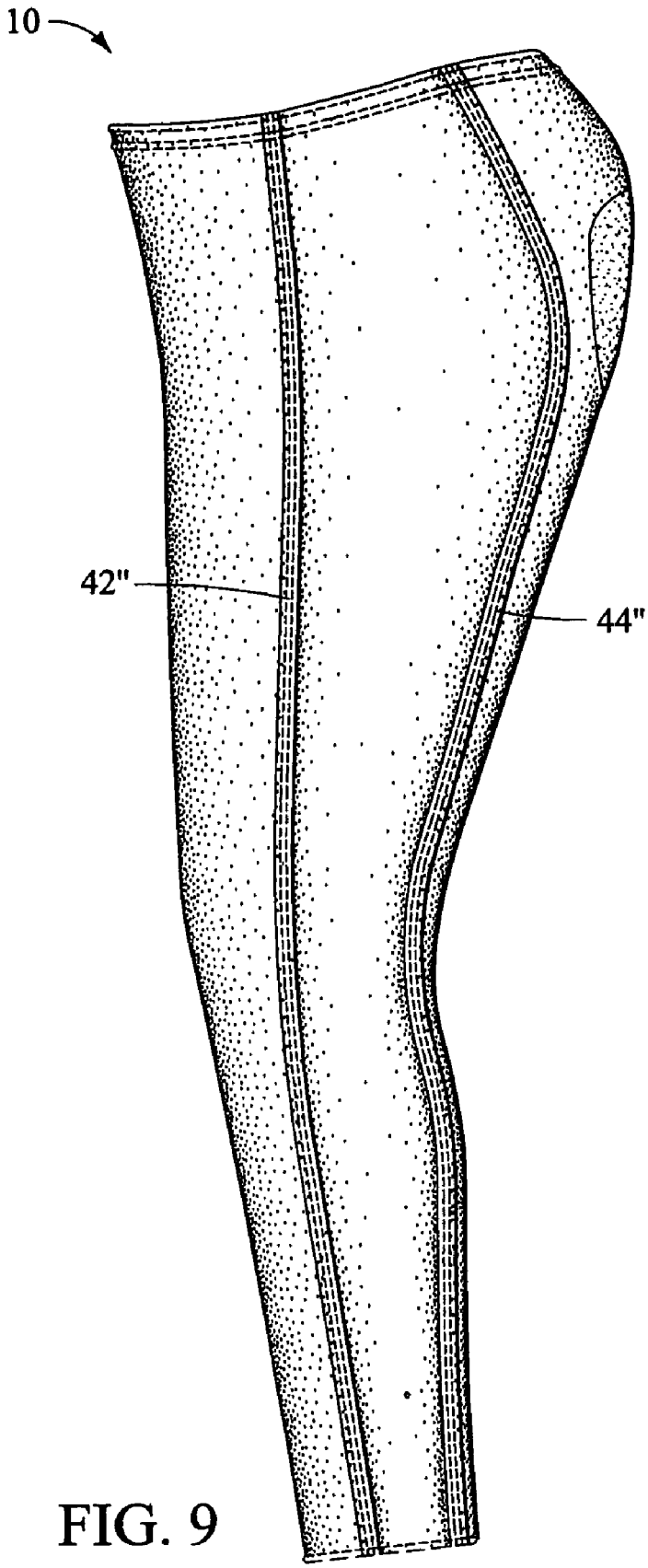
FIG. 9 is a left side elevational view of the equestrian pants of FIG. 1 showing a second alternative seam style.

Any of the seams described above may be made using a variety of seam styles or finishes. In the embodiment illustrated in FIGS. 1-6, for instance, the seams are single seams with no adjacent stitching. FIG. 7 shows a side view of the pants 10 having an alternative seam style. In particular, the seams 42', 44' comprise overlock seams with an edge stitch. As seen in FIG. 7, the edge stitches of the seams 42', 44' are positioned on opposite, outward-facing sides of the seams. FIG. 8 shows the pants of FIG. 7 in a perspective view. As noted above, FIG. 8 also shows an embodiment of the pants 10 having two protective knee patches 90, 92 instead of the full-seat protective surface 36 shown in the other illustrations. FIG. 9 shows a side view of the pants 10 having yet another alternative seam style. In particular, the seams 42", 44" are double seams having two edge stitches. Although only three seam styles are illustrated in FIGS. 1-9, the seams of the pants 10 may be formed using any suitable style or finish (e.g., flat seam, blindstitch seam, two-needle cover seam, French seam, bound finish, Hong Kong finish, etc.). The seams may also be formed such that they lie flat in the interior of the pants (i.e., flat against the legs of the rider). By forming a flat interior surface of the seams, irritation or chafing caused by the friction between the seams and the skin of the rider is reduced.

Any of the contours or angles described above may vary in degree depending on the particular characteristics of the rider. For instance, the contours and angles may depend on the size of the rider (e.g., child, teenager, adult, large adult, etc.), the body type of the rider (e.g., thin, medium, or large lower torso), or other physical aspect of the rider. The contours and angles may also depend on the particular use for the equestrian pants (e.g., steeper angles may be used for riders involved in racing or jumping). The contours and angles also vary in degree depending on the composition and texture of the fabric from which the pants are manufactured. For instance, equestrian pants manufactured from a less stretchable fabric may have angles that are more severe and accentuated than corresponding angles on pants manufactured from more stretchable fabric. Finally, the contours and angles may vary in degree depending on the size and shape of a protective surface that is attached to the pants. For instance, in the embodiment shown in FIG. 2, a protective surface 36 extends across the majority of the backside of the pants and along the interior of the leg portions. Because the protective surface is made of a mostly inflexible material, the stretching characteristics of the pants are altered by the protective surface, and the contours and angles of the pants may need to be more severe and accentuated to compensate for the inclusion of the surface.

Having illustrated and described the principles of the illustrated embodiments, it will be apparent to those skilled in the art that the embodiments can be modified in arrangement and detail without departing from such principles. For example, any of the features described above may be combined in any combination or may be implemented independently of one another. For example, the pants may include a shaped side panel that is shaped into a riding position, but that is otherwise unshaped (i.e., does not include any additional contours). Moreover, although the illustrated embodiments show pants having only two side panels, the pants may include more contoured side panels. Similarly, one or more inner panels may be used to construct the pants. For instance, in one embodiment of the pants, a single inner panel is connected to two side panels, thereby eliminating the presence of the crotch seam. Additionally, the leg portions of the pants may end at a point on the rider's leg other than the ankle region. For instance, the leg portions may terminate at a calf region of the rider's legs.

In view of the many possible embodiments, it will be recognized that the illustrated embodiments include only examples and should not be taken as a limitation on the scope of the invention. Rather, the invention is defined by the following claims. We therefore claim as the invention all such embodiments that come within the scope of these claims.

What is claimed is:

1. Equestrian pants having a waistband, the equestrian pants comprising:

an inner panel forming a majority of a leg of the pants; and at least one side panel forming a remainder of the leg and being connected to the inner panel at multiple side seams, the side panel and side seams being located on an outward-facing side of the pants such that an inward-facing side of the leg is seamless, the at least one side panel being preformed to define a rearward bend of the leg at a knee region of the leg and a forward bend of the leg at an upper-thigh region of the leg, wherein forward is away from a first point of the waistband at the rear of the pants and nearest to the center of a buttocks region of the pants and toward a second point of the waistband at the front of the pants when the pants are in a natural state not bent by an external force, and wherein rearward is opposite of forward.

2. The pants of claim 1, wherein the rearward bend and the forward bend shape the leg into a riding position.

3. The pants of claim 2, wherein the riding position is a seated riding position.

4. The pants of claim 1, wherein the inner panel and side panel further shape the leg such that the leg is bow-legged.

5. The pants of claim 1, further comprising at least a portion of a protective patch positioned on the inward-facing side of the leg.

6. The pants of claim 1, wherein the multiple side seams taper toward an end of a waist region.

7. The pants of claim 1, wherein the pants are made of a stretchable fabric.

8. The pants of claim 1, wherein a back length of the pants is greater than a front length.

9. The pants of claim 1, wherein the multiple side seams are overlock seams with adjacent edge stitches.

10. The pants of claim 1, wherein the multiple side seams are flat in the interior of the legs.

11. The pants of claim 1, wherein one of the multiple side seams is a rearward seam that includes a smoothly curved buttocks-shaped portion at a buttocks region of the pants.

12. The pants of claim 1, wherein one of the multiple side seams is a rearward seam that includes a smoothly curved calf-shaped portion at a calf region of the pants.

13. The equestrian pants of claim 1, wherein the inner panel is a first inner panel and is connected to a second opposite inner panel in a crotch region of the pants via a crotch seam.

14. Equestrian pants, comprising:

an inner panel of stretchable fabric forming a majority of a leg of the pants; and at least one side panel of the stretchable fabric forming an outward-facing left or right side of the pants, the at least one side panel being connected to the inner panel via two or more contoured side seams such that an inward-facing side of the leg is seamless, the inner panel and the at least one side panel being preformed to define a bend of the leg in a forward direction at an upper thigh-region of the pants and a bend of the leg in a rearward direction at a knee region of the pants such that a front edge of the knee region of the pants is farther in the forward direction than a front edge of the upper-thigh region of the pants when the pants are in a natural state not bent by an external force and such that the pants stretch substantially evenly across the legs and a portion of the lower torso of a rider when the pants are worn by the rider in a bent-legged riding position, wherein the forward direction is away from a first point on a waistband of the pants nearest to the center of a buttocks region of the pants and toward a second point on the waistband opposite the first point, and wherein the rearward direction is opposite of the forward direction.

15. The equestrian pants of claim 14, wherein the portion of the lower torso of the rider is the crotch of the rider.

16. The equestrian pants of claim 14, further comprising at least a portion of a protective patch positioned on a saddle-facing side of the leg.

17. The equestrian pants of claim 14, further comprising a protective patch positioned at an inner-knee region of the leg.

18. The equestrian pants of claim 14, wherein the stretchable fabric is a synthetic fabric.

19. The equestrian pants of claim 14, wherein the two or more side seams are overlock seams with adjacent edge stitches.

20. The equestrian pants of claim 14, wherein the pants further comprise a cuff connected to an ankle region of the pants, and wherein the front edge of the knee region of the pants is farther in the forward direction than a line segment connecting a point on the upper-thigh region of the pants farthest in the forward direction and a point of the cuff farthest in the forward direction when the pants are in the natural state not bent by an external force.

21. Equestrian pants, comprising:

a waistband; and a leg portion made of stretchable fabric connected to the waistband and comprising a side panel and an inner panel having a front edge and a rear edge, the inner panel and the side panel being connected to one another by first and second outward-facing side seams, the first side seam originating at a forward position on a waistband relative to the second side seam and extending in a first contoured path to a first distal end of the leg portion, the first contoured path extending around a forward side of a natural bone protrusion of a rider when the pants are worn by the rider in a riding position, the second side seam originating at a rearward position on the waistband relative to the first side seam and extending in a second contoured path to a second distal end of the leg portion, the second contoured path extending around a rearward side of the natural bone protrusion of the rider when the pants are worn by the rider in the riding position, the leg portion being shaped by the side panel and the inner panel such that a front edge of a knee region of the leg portion is farther forward than a front edge of an upper-thigh region of the leg portion when the pants are unbent by an external force and such that the first contoured path and the second contoured path are also present in the leg portion of the pants when the pants are unbent by an external force, wherein forward is in a direction that is away from a first point at the intersection of the waistband and the rear edge of the inner panel and toward a second point at the intersection of the waistband and the front edge of the inner panel when the pants are unbent by an external force, and wherein rearward is in a direction that is opposite of forward.

22. The equestrian pants of claim 21, wherein the natural bone protrusion is a hipbone of the rider.

23. The equestrian pants of claim 21, wherein the natural bone protrusion is a hip joint of the rider.

24. The equestrian pants of claim 21, wherein the natural bone protrusion is an ischium of the rider.

25. The equestrian pants of claim 21, wherein the natural bone protrusion is an end of the femur of one of the rider's legs.

26. The equestrian pants of claim 21, wherein the second contoured path includes a smoothly curved buttocks-shaped portion at a buttocks region of the pants.

27. The equestrian pants of claim 21, wherein the first and second contoured paths are shaped into a riding position.

28. The equestrian pants of claim 21, wherein the shaped side panel and the inner panel are shaped for a riding position such that the pants stretch evenly across the legs and a portion of the lower torso of a rider when the pants are worn in the riding position.

* * * * *